US006483086B1

(12) United States Patent
Wolff et al.

(10) Patent No.: US 6,483,086 B1
(45) Date of Patent: Nov. 19, 2002

(54) DEICING MATS

(76) Inventors: Frederick F. Wolff, 112 Bibb Dr., Madison, AL (US) 35758; Nabil T. Hussani, 115 Bibb Dr., Madison, AL (US) 35758

( * ) Notice: Subject to any disclaimer, the term of this patent is extended or adjusted under 35 U.S.C. 154(b) by 0 days.

(21) Appl. No.: 09/909,648

(22) Filed: Jul. 20, 2001

(51) Int. Cl.[7] ..... H05B 3/34

(52) U.S. Cl. ..... 219/528; 219/213; 219/549; 219/477; 338/208

(58) Field of Search ..... 219/213, 528, 219/477, 529, 549, 544, 545; 338/208

(56) References Cited

U.S. PATENT DOCUMENTS

| | | | | |
|---|---|---|---|---|
| 223,784 A | | 1/1880 | Watson | |
| 2,844,696 A | | 7/1958 | Custer, Jr. | |
| 2,912,555 A | | 11/1959 | Jamison | |
| 4,246,982 A | * | 1/1981 | Pretnick | 184/106 |
| 4,967,057 A | | 10/1990 | Bayless et al. | |
| 5,298,722 A | * | 3/1994 | Tanaka | 219/545 |
| 5,591,365 A | | 1/1997 | Shields | |
| 5,614,292 A | | 3/1997 | Saylor | |
| 6,051,811 A | * | 4/2000 | Hardison | 219/213 |

* cited by examiner

*Primary Examiner*—Teresa Walberg
*Assistant Examiner*—Shawntina T. Fuqua
(74) *Attorney, Agent, or Firm*—Gene Scott-Patent Law & Venture Group

(57) ABSTRACT

A deicing apparatus comprises an integral stack of layers inseparably joined in intimate mutual contact forming a flexible mat. The layers include a first layer to be placed into contact with a surface to be deiced or to be maintained clear of ice, having electrical insulation properties, a second layer of resistance heating, electrically conductive material formed in an electrical conducting path, a third layer of electrically insulating material, a forth heat energy reflective layer of metallic foil, and a fifth layer of thermally insulative and physically tough material. A device for applying an electrical current to the second layer to produce heat energy is provided.

7 Claims, 8 Drawing Sheets

DEICING MATS

BACKGROUND OF THE INVENTION

1. Field of the Invention

This invention relates generally to heating elements and such for deicing surfaces exposed to severe cold.

2. Description of Related Art

The following art defines the present state of this field:

Watson, U.S. Pat. No. 223,784 describes castings formed in sections, connected by curved pipes, in combination with the enclosed pipes and connections arranged to serve as a pavement for sidewalks or streets or both.

Custer, Jr., U.S. Pat. No. 2,844,696 describes a melting mat comprising a sheet of electrically insulative material having an electrically conductive heating coil embedded therein, a heat conductive wire mesh overlying said sheet, a tread of electrically insulative material positioned over said wire mesh and bonded to said wire mesh and said sheet sandwiching said wire mesh between said tread and said sheet, metallic ground strips secured to said mat, said wire mesh being connected to said ground strips.

Jamison, U.S. Pat. No. 2,912,555 describes a heated surface covering device for multiple use in overlying and in end to end relation to form walkways, driveways, roadways or the like, comprising a flat molded rectangular plastic body having parallel upper and lower faces, a non-plastic heater element molded into the body to extend for the major width and length thereof, the heater clement comprising a rectangular sheet of stiff and relatively thick insulating board, the board at its opposite ends being provided with spaced apart perforations, a plurality of strands of an electrical conductor that are connected to the sheet and that extend longitudinally of the sheet and with the strands overlying the upper surface of the sheet in spaced apart parallel relation and whereby the major heat from the strands is directed toward the surface of the plastic body, the strands being threaded through the apertures at the opposite ends of the sheet, the said sheet insulating the lower surface of the body against the escape of heat downwardly from the contended through one marginal edge of the plastic body adjacent one end for connection to a source of electrical energy, the said body portion at its opposite ends being transversely reduced in thickness to form flat tongue for the full transverse width of the slabs and whereby the tongues have overlapping engagement with the tongues or adjacent bodies, each of the bodies inwardly from their reduced ends being vertically apertured for the passage of anchoring pins that are driven downwardly into an underlying surface to prevent shifting of the bodies with respect to each other and with respect to an underlying surface, all of the slabs and their projecting conductors being energized and heated from a common source of electrical energy.

Bayless et al., U.S. Pat. No. 4,967,057 describes individual electrically heated mats, self-regulated by use of an electrical element whose resistance varies proportionately with its temperature, used for covering walking areas to prevent accumulation of snow and ice. Each mat is provided with male and female electrical connections on the ends of short power cords to permit any number of mats to be chained together in electrical parallel and to be used to cover, for example, a flight of stairs by positioning one mat on each stair.

Shields, U.S. Pat. No. 5,591,365 describes a heating apparatus for preventing the accumulation of snow and ice, and having an apertured heating mat in the form of a lattice or web. The heating mat is made of a durable weatherproof insulative polymer so that the mat may be installed on any outdoor surface, such as a driveway, walkway, or rooftop. The apertures within the lattice serve to increase the flexibility of the mat, thus allowing the mat to fit uneven surfaces. In addition, this flexibility allows the mat to be easily rolled up when not in use, the apparatus therefore only occupying minimal storage space. The heating mat is also constructed to be highly resistant to wear and may be left outdoors for the entire snow season, exposed to both the elements and frequent vehicular traffic without losing its effectiveness. Also included is;a controller from which the apparatus can be set to a manual mode, in which the apparatus may be manually activated, or an automatic mode, in which the apparatus is automatically activated by snowfall.

Saylor, U.S. Pat. No. 5,614,292 describes a thermal walkway cover comprising at least three laminated layers including a middle layer of electrically conductive carbonized rubber, a durable, waterproof, UV-resistant top layer, and an insulating, waterproof bottom layer. Means are provided in to form of electrically conductive strips embedded in the middle layer to heat the middle layer. Connections are provided to a power source. The cover may have one or more edges of a dovetail construction so that cover sections or modules may be connected together to cover a desired walkway area, in which case electrical connections are provided between individual modules.

The prior art teaches the use of buried heating strips for heating rooms, driveways, air strips and other applications, but does not teach the present specific combination of elements which provide advantages as described in the following summary.

SUMMARY OF THE INVENTION

The present invention teaches certain benefits in construction and use which give rise to the objectives described below.

A deicing apparatus comprises an integral stack of layers inseparably joined in intimate mutual contact forming a flexible mat. The layers include a first layer to be placed into contact with a surface to be deiced or to be maintained clear of ice, having electrical insulation properties, a second layer of resistance heating, electrically conductive material formed in an electrical conducting path, a third layer of electrically insulating material, a forth heat energy reflective layer of metallic foil, and a fifth layer of thermally insulative and physically tough material. A device for applying an electrical current to the second layer to produce heat energy is provided.

A primary objective of the present invention is to provide an apparatus and method of use of such apparatus that provides advantages not taught by the prior art.

Another objective is to provide such an invention capable of deicing an area around an automobile tire.

A further objective is to provide such an invention capable of deicing a handle and lock on an automobile door.

A still further objective is to provide such an invention capable of use with 12-volt dc or 115-volt ac power sources.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention in at least one of its preferred embodiments, which is further defined in detail in the following description.

Figure 1:
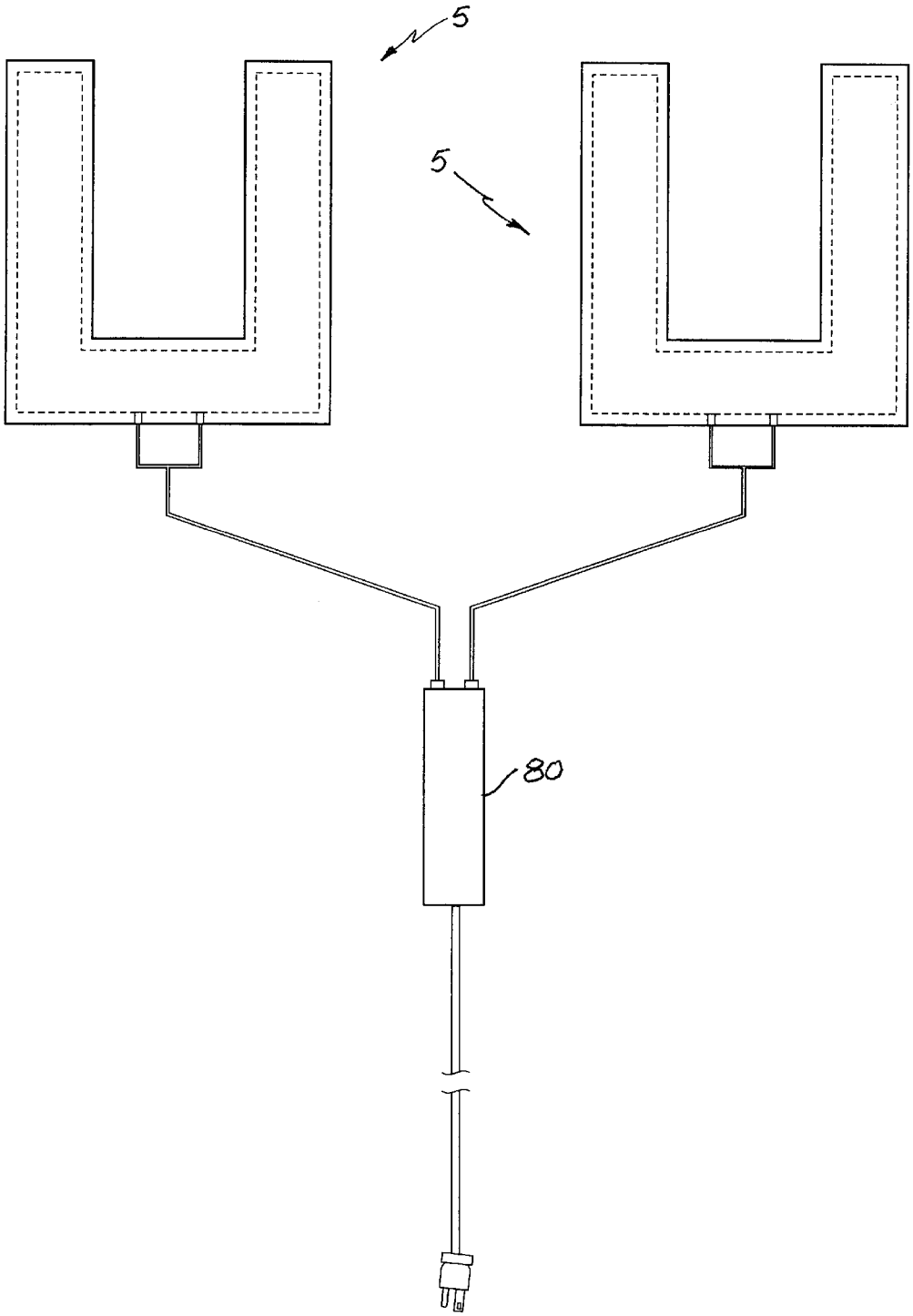
FIGS. 1–3 are plan views of a preferred embodiment of the invention as applied to deicing a tire area of an automobile using different power sources.
Figure 2:
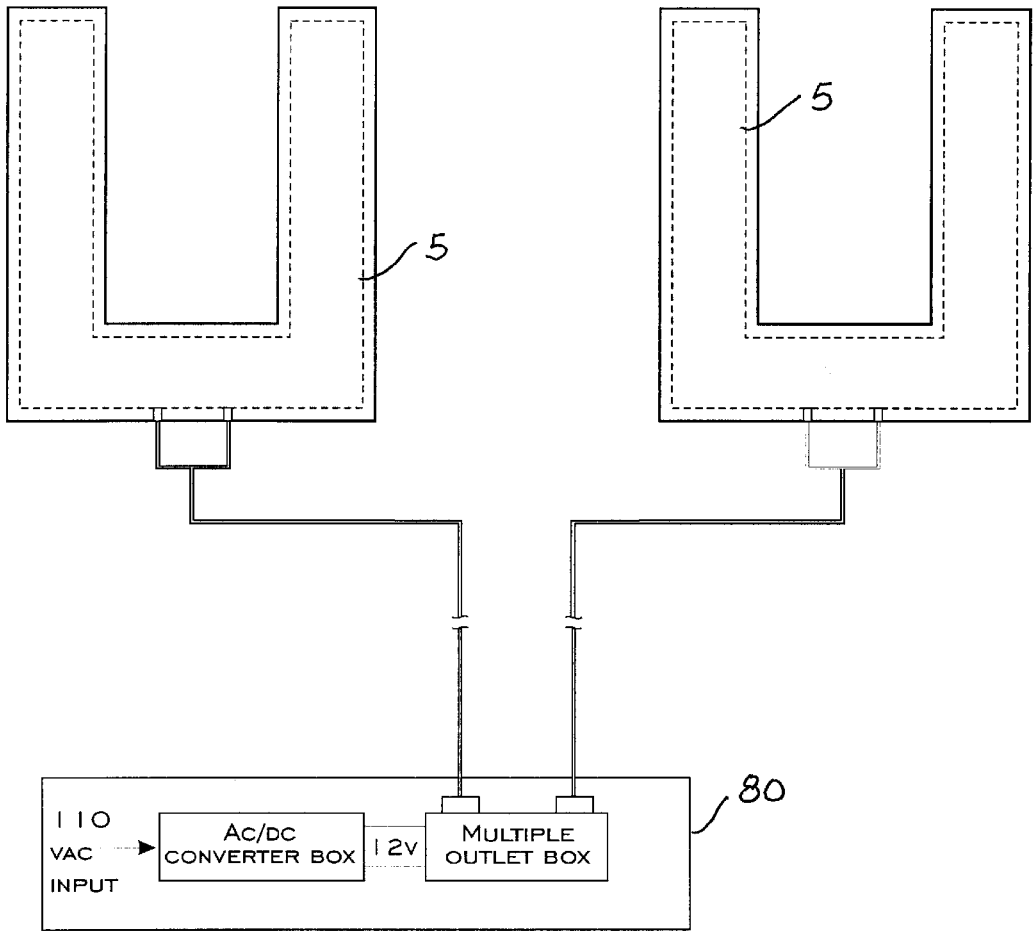
Figure 3:
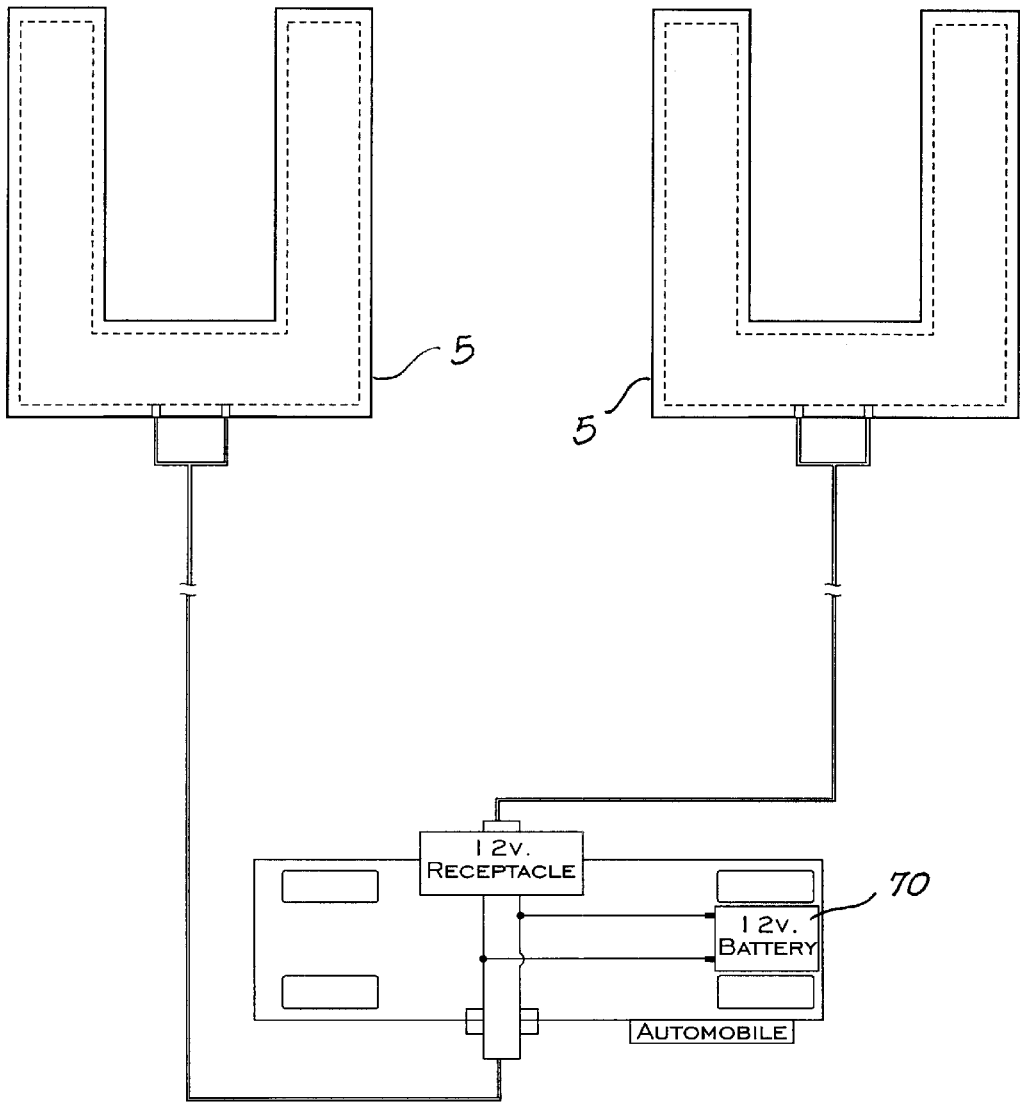
Figure 4:
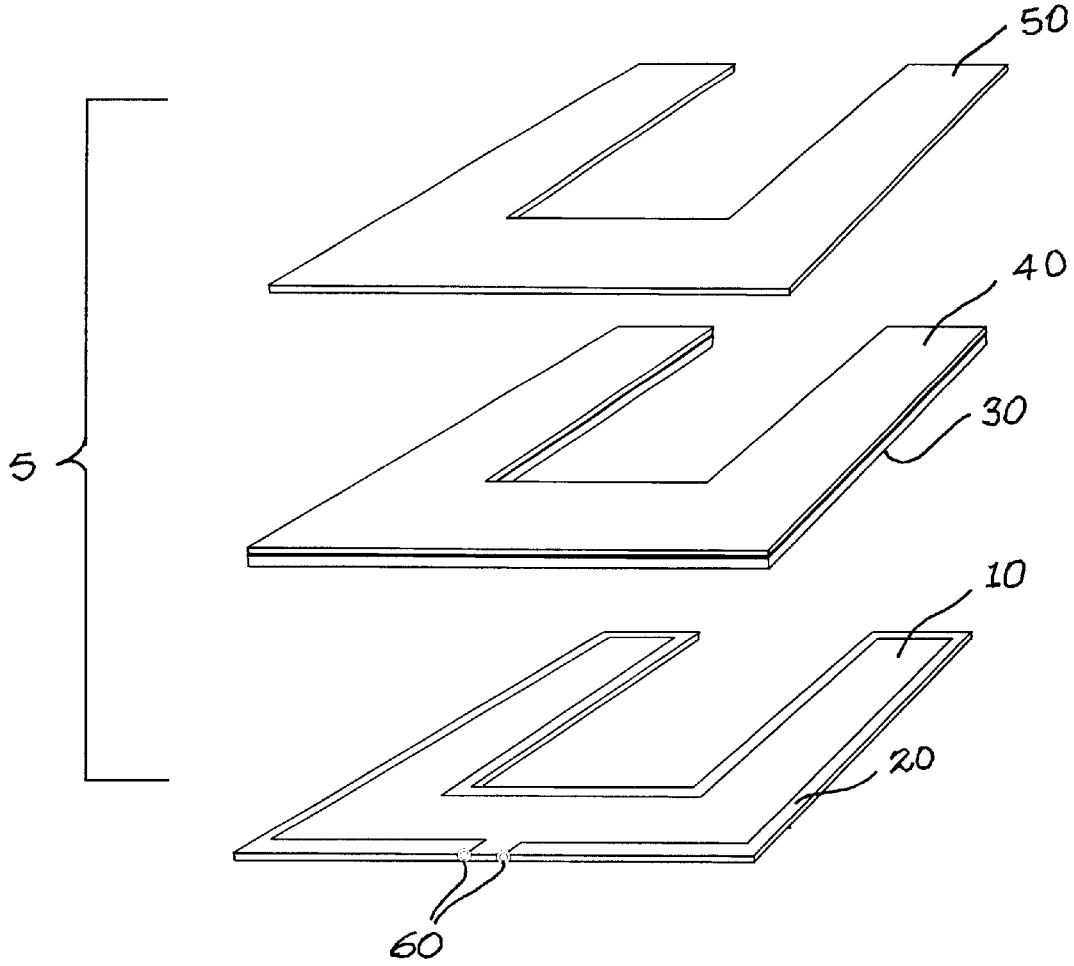
FIG. 4 is a perspective exploded view thereof showing the various layers of construction.

The present invention is a deicing apparatus comprising an integral stack of layers inseparably joined in intimate mutual contact, forming a flexible mat 5. The layers are preferably bonded together, and, as stated, are designed and fashioned to remain together over the life of the product. The layers include a first layer 10, in contact with a surface to be deiced, having an electrical insulation property as would be found in a rubber or plastic sheet of several mils thickness, a second layer 20 of resistance heating, electrically conductive material, such as copper metal, formed as an electrical conducting path (FIG. 4), a third layer 30 of electrically insulating material such as a high temperature plastic such as polysulfone of approximately 1 mil thickness, a forth layer 40 of metallic foil, such as a 10 mil aluminum metal for reflecting heat downwardly, toward the surface supporting the mat 5, a fifth layer 50 of thermally insulating and physically tough material such as a rubber sheet, and a means for applying 60 an electrical current to the second layer 20, such as common electrical connectors, to produce heat energy. With electrical energy applied, the mat 5 tends to heat uniformly to prevent icing of surfaces in contact with the first layer 10.

Figure 5:
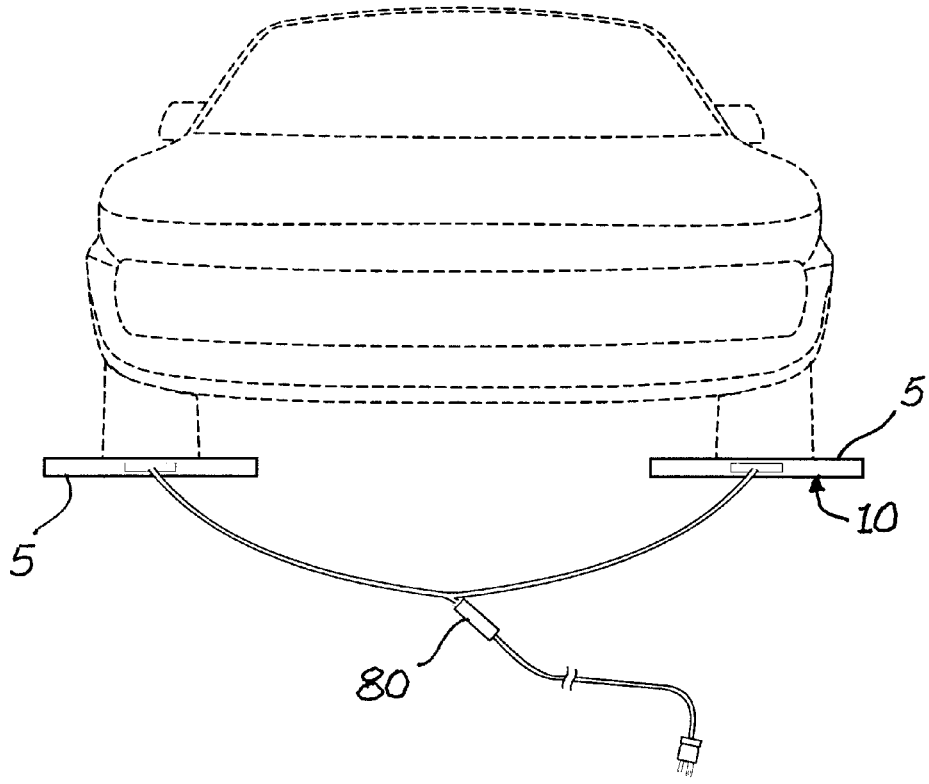
FIG. 5 is a front elevation view thereof showing application to an automobile front tires.

In one embodiment, the apparatus is formed into a U-shape as shown in FIGS. 1–4. In this case, the U-shape flexible mat 5 is of a size for adjacent placement on three sides of an automobile tire as best seen in FIG. 5.

Preferably, the second layer 20 is adapted for producing a selected quantity of heat energy from a 12-volt dc electrical source such as an automobile electrical system 70. Alternately, the apparatus may include a 115-volt ac to 12-volt dc converter system 80 to enable the use of a utility electrical supply as a source of energy.

Figure 6:
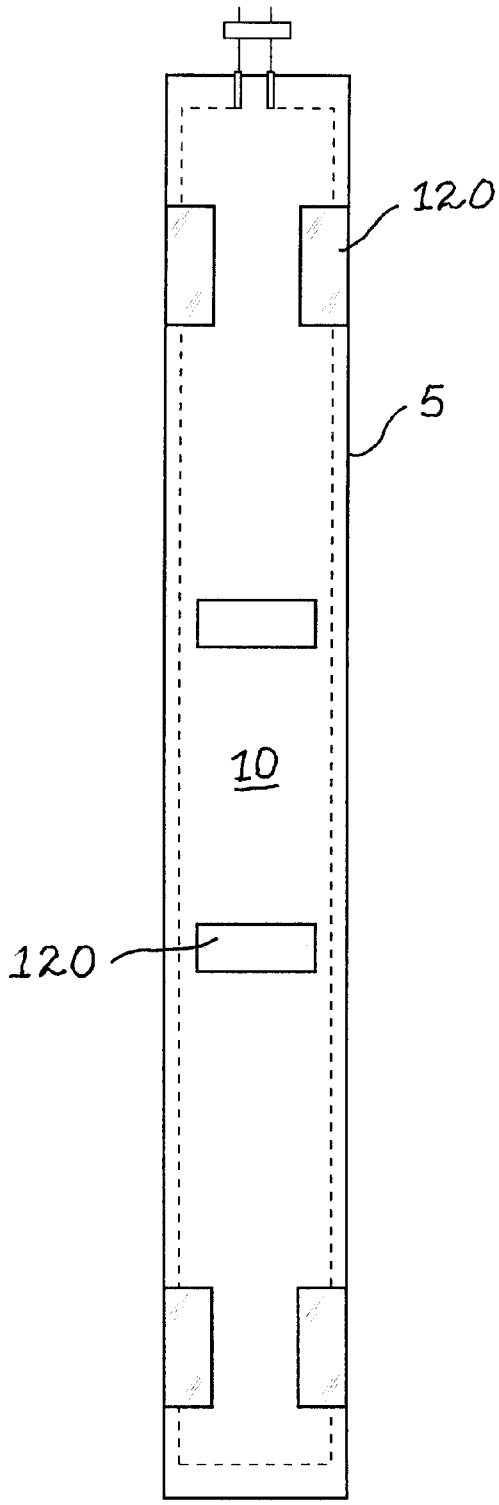
FIGS. 6 and 7 are a plan and side view respectively of a further embodiment of the invention for use with an automobile door.
Figure 7:
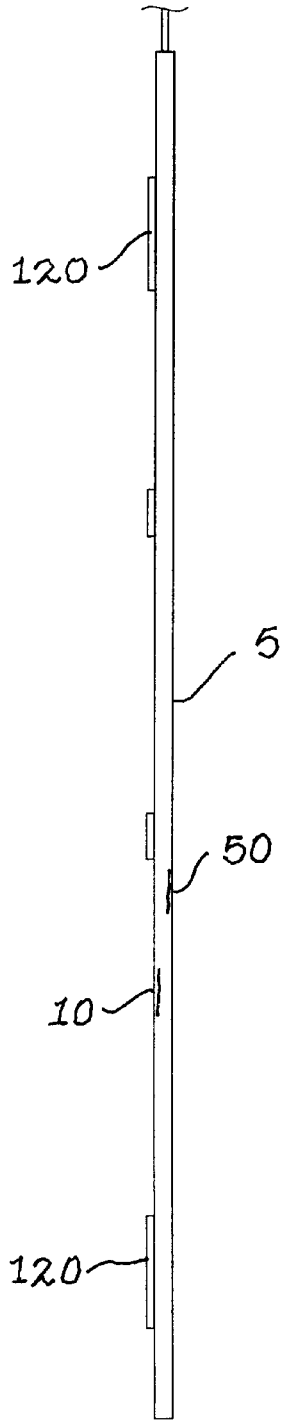
Figure 8:
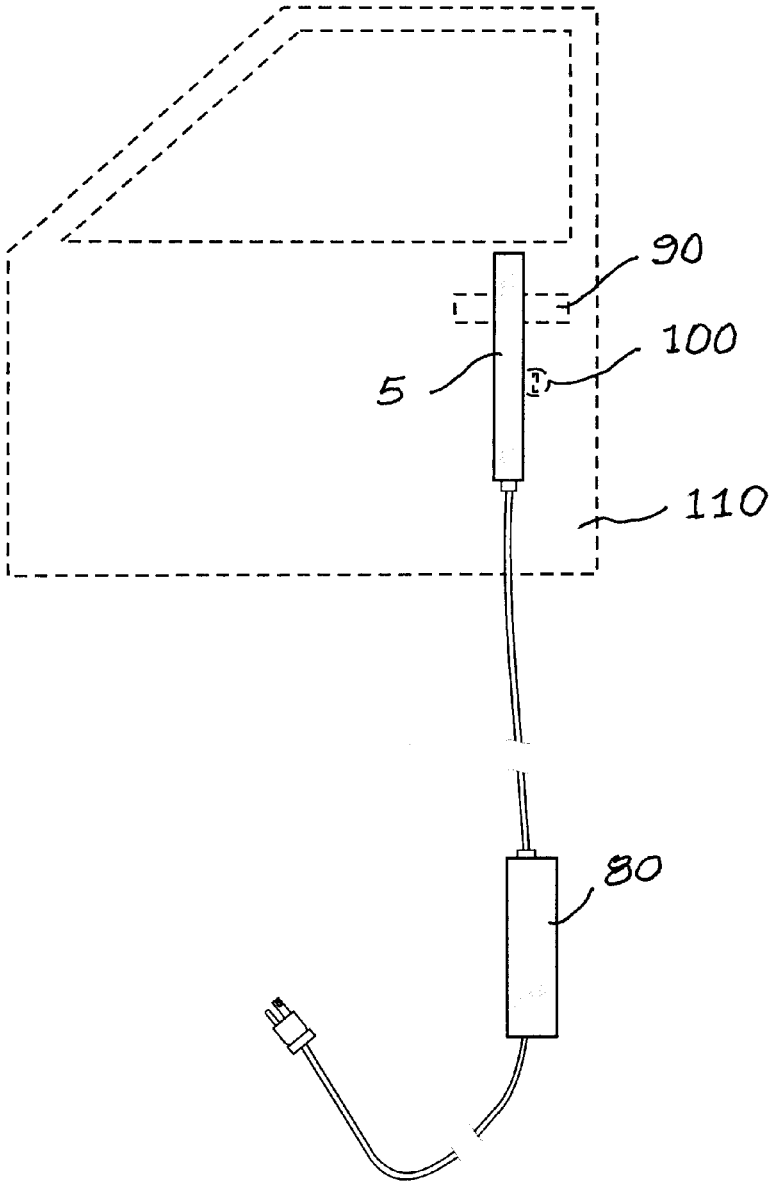
FIG. 8 is a side elevational view of an automobile door showing an application thereof.

In an alternate embodiment, (FIGS. 6–8) the flexible mat 5 may be formed with a length capable of extending from a handle 90 to a lock 100 of an automotive door 110 so as to keep these parts from freezing. A means for magnetic attraction mounting 120 of the flexible mat 5, such as flat magnets as shown in FIGS. 6 and 7 are usefully attached to the first layer 10.

Other embodiments of the present invention include forming the flexible mat 5 with a length for deicing a path on a ground surface to, for instance, keep a driveway or other path clear of ice, or of application to a set of outside steps. The flexible nature of the mat 5 is beneficial for the application to steps.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A deicing apparatus comprising in combination: a vehicle positioned for deicing on an integral stack of layers inseparably joined in intimate mutual contact forming a flexible mat; including a first layer having electrical insulation properties, a second layer of resistance heating, electrically conductive material formed in an electrical conducting path, a third layer of electrically insulating material, a forth layer of metallic foil, a fifth layer of thermally insulative and physically tough material, and a means for applying an electrical current to the second layer to produce heat energy; a portion formed with a length extending from a handle to a lock of a door of the vehicle.

2. The apparatus of claim 1 formed into a U-shape.

3. The apparatus of claim 2 wherein the U-shape flexible mat is of a size for adjacent placement on three sides of an automobile tire.

4. The apparatus of claim 1 wherein the second layer is adapted for producing a selected quantity of heat energy from a 12-volt dc electrical source.

5. The apparatus of claim 4 further comprising a 115-volt ac to 12-volt dc converter system.

6. The apparatus of claim 1 further comprising a means for magnetic attraction mounting, the mounting means attached to the first layer.

7. The apparatus of claim 1 of a length for deicing a path on a ground surface.

* * * * *